US011486118B2

(12) United States Patent
Preisig et al.

(10) Patent No.: US 11,486,118 B2
(45) Date of Patent: Nov. 1, 2022

(54) DRAIN ARRANGEMENT FOR A WASHSTAND

(71) Applicant: Geberit International AG, Jona (CH)

(72) Inventors: Felix Imo Preisig, Uerikon (CH); Marco Oberholzer, Eschenbach (CH); Michael Schintler, Pfäffikon (CH)

(73) Assignee: GEBERIT INTERNATIONAL AG, Jona (CH)

( * ) Notice: Subject to any disclaimer, the term of this patent is extended or adjusted under 35 U.S.C. 154(b) by 5 days.

(21) Appl. No.: 17/042,597

(22) PCT Filed: Mar. 28, 2019

(86) PCT No.: PCT/EP2019/057884
§ 371 (c)(1),
(2) Date: Sep. 28, 2020

(87) PCT Pub. No.: WO2019/185810
PCT Pub. Date: Oct. 3, 2019

(65) Prior Publication Data

US 2021/0095447 A1 Apr. 1, 2021

(30) Foreign Application Priority Data

Mar. 29, 2018 (EP) ..... 18164992
Mar. 29, 2018 (EP) ..... 18164995
(Continued)

(51) Int. Cl.
*E03C 1/232* (2006.01)

(52) U.S. Cl.
CPC ..... *E03C 1/232* (2013.01)

(58) Field of Classification Search
CPC ..... E03C 1/232; E03C 1/2304
(Continued)

(56) References Cited

U.S. PATENT DOCUMENTS 4,594,738 A * 6/1986 Gebert ..... E03C 1/232 251/294
4,777,676 A 10/1988 Ericson
(Continued)

FOREIGN PATENT DOCUMENTS

DE 10 2008 044 637 A1 10/2009
DE 20 2008 006 611 U1 11/2009
(Continued)

OTHER PUBLICATIONS

International Search Report of PCT/EP2019/057884 dated Jul. 2, 2019 [PCT/ISA/210].
(Continued)

*Primary Examiner* — Tuan N Nguyen
(74) *Attorney, Agent, or Firm* — Sughrue Mion, PLLC

(57) ABSTRACT

A drain arrangement for a washstand, comprising a connection unit having a connecting branch for connection to a drain branch of a washstand, an overflow unit connecting to the connection unit and having a valve and an overflow pipe, which bridges the valve, and a siphon unit connecting to the overflow unit and having a siphon element. The connecting branch, seen in the installation position, runs in a first direction, which is oriented at an angle inclined at less than 30° tilting downwards to a mounting plane running in the vertical of the washstand. The overflow unit lies offset to the side of the connecting branch in such a manner that the overflow pipe extends upwards to the side adjacent to the connecting branch and the siphon unit lies beneath the overflow unit.

22 Claims, 5 Drawing Sheets

(30) Foreign Application Priority Data

| | | |
|---|---|---|
| May 16, 2018 | (EP) | 18172684 |
| Jan. 11, 2019 | (EP) | 19151433 |
| Jan. 11, 2019 | (EP) | 19151436 |
| Jan. 29, 2019 | (EP) | 19154228 |

(58) Field of Classification Search
USPC ..... 4/680, 682, 683, 688, 647, 671–674
See application file for complete search history.

(56) References Cited

U.S. PATENT DOCUMENTS

| | | | |
|---|---|---|---|
| 5,625,909 | A | 5/1997 | Ericson |
| 2008/0196161 | A1 | 8/2008 | Ball |

FOREIGN PATENT DOCUMENTS

| | | | |
|---|---|---|---|
| EP | 1 267 005 | A2 | 12/2002 |
| EP | 1 754 838 | A2 | 2/2007 |
| JP | 11-200444 | A | 7/1999 |
| NL | 1032117 | C2 | 1/2008 |
| WO | 2015/196248 | A1 | 12/2015 |

OTHER PUBLICATIONS

Written Opinion of PCT/EP2019/057884 dated Jul. 2, 2019 [PCT/ISA/237].
European Search Report dated Oct. 18, 2018, issued by the European Patent Office in application No. 18 16 4995.

* cited by examiner

DRAIN ARRANGEMENT FOR A WASHSTAND

CROSS REFERENCE TO RELATED APPLICATIONS

This application is a National Stage of International Application No. PCT/EP2019/057884 filed on Mar. 28, 2019, claiming priority based on European Patent Application No. 18164995.5 filed on Mar. 29, 2018, European Patent Application No. 18164992.2 filed on Mar. 29, 2018, European Patent Application No. 18172684.5 filed on May 16, 2018, European Patent Application No. 19151436.3 filed on Jan. 11, 2019, European Patent Application No. 19151433.0 filed on Jan. 11, 2019, and European Patent Application No. 19154228.1 filed on Jan. 29, 2019, the disclosure of which is incorporated herein in its entirely by reference.

TECHNICAL FIELD

The present invention relates to a drain arrangement for a washstand, according to claim 1, and to an arrangement comprising a washstand and the drain arrangement according to claim 15.

PRIOR ART

From the prior art, various types of drain arrangements for washstands have been disclosed. The principal drawback of the known drain arrangements is that these are not of compact configuration and sometimes have complex diversions. The former is disadvantageous in terms of the required installation space and the latter is disadvantageous in terms of the hydraulic discharge capacity.

REPRESENTATION OF THE INVENTION

Starting from the prior art, an object of the invention is to define a drain arrangement which overcomes the drawbacks of the prior art. A particularly preferred object is to define a drain arrangement which is of compact configuration.

This object is achieved by the drain arrangement as claimed in claim 1. According to this, a drain arrangement for a washstand comprises a connection unit having a connecting branch for connection to a drainage branch of a washstand; an overflow unit adjoining the connection unit and comprising a valve and an overflow pipe which bridges the valve, and a siphon unit adjoining the overflow unit and comprising a siphon element. The connection unit, the overflow unit and the siphon unit are operatively connected here, such that wastewater flowing out of the washstand is transferable from the connection unit to the overflow unit, and subsequently to the siphon unit. That is to say that the wastewater flows through the appropriate units. The connecting branch, when viewed in the installation position, runs in a first direction, which is oriented angularly inclined, at an angle, downward toward an assembly plane of the washstand, which assembly plane runs in the vertical. The connecting branch is inclined downward with respect to the horizontal. The overflow unit lies laterally offset from the connecting branch such that the overflow pipe extends upward alongside the connecting branch. That is to say that the overflow pipe extends next to and past the connecting branch upward in the vertical. The siphon unit lies beneath the overflow unit.

By virtue of this arrangement, a compact structure can be created. In particular since the overflow pipe and overflow unit, respectively, are arranged above the siphon unit, and because the connecting branch is arranged laterally offset from the overflow pipe.

Said angle is preferably less than 30° and, particularly preferably, lies between 2° and 30°.

The expressions "vertical" and "horizontal" should be regarded as a defined direction in the installation position. The vertical here corresponds to the plumb line direction and the horizontal lies at right-angles to the vertical.

The referencing of the position of said units relative to one another, or the position of subcomponents of the units, should respectively be understood to apply in the installation position.

The assembly plane is preferably defined by a connecting structure which is visible to the user, such as, for instance, the wall of a bathroom or the front wall of an assembly frame.

Preferably, in the installation position, the connecting branch penetrates the assembly plane. The overflow unit and the siphon unit are arranged, with respect to the assembly plane, opposite the washstand. The overflow unit and the siphon unit lie behind the assembly plane here, and the washstand lies in front of the assembly plane. The overflow unit and the siphon unit lie on one side of the assembly plane here, and the washstand lies on the other side of the assembly plane. Particularly preferably, the assembly plane is provided by a wall or wall structure. That is to say then that the connecting branch penetrates the wall or wall structure, respectively, wherein the washstand lies in front of the wall, and the overflow unit and the siphon unit lie behind the wall or wall structure, respectively. This arrangement has the advantage that the spatial region beneath the washstand remains vacant.

Preferably, in the installation position and when viewed from the side, the overflow unit and the siphon unit are arranged such that these lie between two reference planes lying parallel to the assembly plane, wherein the reference planes have a distance inbetween them which corresponds to maximally three times the length of the connecting branch; and/or wherein the reference planes have a distance inbetween them which lies between 7 and 25 centimeters.

When viewed in the installation position, the reference planes lie behind the assembly plane, and thus behind the wall of the bathroom or the front wall of an assembly frame.

The arrangement of the two units between the two reference planes has the advantage that the compactness can be enhanced.

Preferably, the reference planes lie at a distance from the assembly plane. The distance between the assembly plane and the first reference plane lying closer to the assembly plane is preferably smaller than the distance between the two reference planes.

The distanced arrangement between the assembly plane and the reference plane yields the advantage that space can be created between the washstand and the overflow unit, and also the siphon unit, through which space a freshwater conduit or other elements can be fed to the washstand. A part of the space is required, moreover, for the feed-through of said connecting structure.

Particularly preferably, from all parts of the drain arrangement only or solely the connecting branch extends through the space between assembly plane and reference plane.

Preferably, the connecting branch, when viewed from the washstand, penetrates the first reference plane and, between the first reference plane and the second reference plane, opens out into the overflow unit. Furthermore, the connecting branch also penetrates the assembly plane.

Preferably, in the installation position, the overflow pipe extends upward over the height of the connecting branch.

Preferably, in the installation position, the valve and the siphon unit lie beneath the connecting branch or the drainage branch, respectively.

Preferably, the connecting branch has a first diversion section, which diverts the direction of flow from the first direction downward into the vertical. The connecting branch further has a second diversion section, which is arranged following the first diversion section and which rediverts the direction of flow, wherein the orientation of the center axis of the second diversion section, after diversion has taken place, is parallel to and at a distance from the assembly plane and angularly inclined downward with respect to the horizontal.

Preferably, the second diversion section is adjoined by the overflow unit.

Preferably, the connecting branch has at least one flexible section, wherein, in particular, at least one of the diversion sections is of flexible configuration. As a result, positional and/or angular tolerances between washstand and connection unit can be compensated comparatively easily.

Preferably, the center axes of the water-carrying regions in the overflow unit and the siphon unit run substantially in a common plane which runs parallel to the assembly plane. This has the advantage that the compactness of the drain arrangement can be further enhanced.

Preferably, the overflow unit and the siphon unit each have a maintenance opening closed off with a cap, wherein the two maintenance openings are accessible from the same access direction.

Through the maintenance openings, in particular the valve and the siphon are accessible, so that in the event of a leaky valve or blocked siphon, for instance, appropriate maintenance works can be carried out.

Preferably, said access direction runs at right angles to the assembly plane. That is to say that the two maintenance openings, in the installation position, are accessible from the front. From the front means from the washstand.

Preferably, the two maintenance openings, when viewed in the vertical, lie one above the other.

Preferably, the maintenance openings closed off with the cap lie, in the installation position, beneath the washstand. The access is hence not restricted by the washstand.

Preferably, the caps each have an actuating element accessible from outside the housing. The actuating element is preferably configured such that this can be comfortably gripped manually, without the aid of a tool.

Preferably, through the maximal lateral extent of the siphon unit in the horizontal direction, in a projection onto the assembly plane, there respectively runs a reference plane, which reference planes run at right angles to the assembly plane in the vertical, wherein the siphon unit and the overflow unit are arranged in the region between the two reference planes.

Preferably, the reference planes lie at a distance of 10 to 15 centimeters apart.

An arrangement comprises a drain arrangement according to the above description and a washstand, wherein the washstand has a rear wall, with which the washstand is fittable to a connecting structure defining the assembly plane, and wherein the washstand has a drainage branch, which protrudes from said rear wall and which runs, in particular, collinearly to said connecting branch.

Preferably, the connecting branch penetrates the assembly plane, wherein the overflow unit and the siphon unit are arranged, with respect to the assembly plane, opposite the washstand. The overflow unit and the siphon unit lie behind the assembly plane, and the washstand lies in front of the assembly plane. This arrangement has the advantage that the spatial region beneath the washstand remains vacant.

In a refinement, the arrangement further has a wall structure which, with a front side, defines the assembly plane, wherein the washstand is arranged in front of the wall structure, wherein the connecting branch penetrates the wall structure, and wherein the overflow unit and the siphon unit lie behind the wall structure. The wall structure is, for instance, a wall, a front wall, or a wall or front wall, respectively, which is part of an assembly frame.

Preferably, the drainage branch, with respect to a center plane which in the installation position, when viewed from the front, extends centrally in the vertical through the washstand and which runs at right angles to the assembly plane, is arranged laterally offset from the center plane.

Below, some particularly advantageous optional elements of the siphon unit and of the overflow unit are described.

The overflow unit has a drainage pipe having a pipe entrance and a pipe exit, wherein the valve is arranged in a valve section of the drainage pipe, which valve comprises a sealing surface and a valve body, wherein the valve body is movable with an actuating element away from the sealing surface, from a closure position into an open position. The overflow pipe extends from a first branch-off point lying upstream of the valve, when viewed in the direction of flow of the water, to a second branch-off point lying downstream of the valve in the direction of flow of the water, away from the drainage pipe, and thus bridges the valve. In the installation position, the overflow pipe extends upward substantially counter to the plumb line direction. The valve body is preferably accessible through the maintenance opening. Here, the pipe entrance is connected to the connection unit and the pipe exit opens out into the siphon unit.

Preferably, the actuating element is also arranged between the two reference planes.

Preferably, the overflow unit is configured such that pipe inlet and pipe outlet are inclined at an angle to one another. In particular, the pipe outlet, in the installation position, runs in the vertical, while the pipe inlet runs in said second direction. Preferably, that pipe section of the overflow unit which adjoins the pipe entrance in the direction of flow extends substantially in the horizontal or angularly inclined to the horizontal at an angle of maximally 20°.

Preferably, the overflow pipe is provided as a U-shaped pipe section. Preferably, the overflow pipe is connected to the two branch-off points via a mechanical plug-and-socket connection.

Preferably, the actuating element is a Bowden cable having a sleeve and a cable mounted therein, which cable acts on the valve body, wherein the sleeve is mounted on the insert element. The cable acts, in particular, on the free end of the lever arm of the bearing axis.

The siphon unit is preferably constituted by a rotary siphon.

Particularly preferably, the siphon unit comprises a housing having an inlet branch, an outlet branch and a siphon seat arranged between inlet branch and outlet branch, and further comprises a siphon element arranged in the siphon seat and having a siphon section, as well as an inlet, which faces the inlet branch, and an outlet, which leads to the outlet branch. Water can be guided from the inlet branch into the siphon section via the inlet, and from the outlet to the outlet branch.

The overflow unit is connectable to the inlet branch, and a wastewater conduit is connectable to the outlet branch. The siphon element is mounted in the housing so as to be movable from a usage position into a maintenance position, and is removable, in particular extractable, from the housing from the maintenance position along a principal direction via a maintenance opening. The principal direction preferably extends along a straight line. The siphon element is preferably configured such that, in its maintenance position, it is substantially completely emptied. That is to say that no or only an insignificant quantity of residual water is present in the siphon element after the siphon element has been moved from the usage position into the maintenance position. Furthermore, the siphon element and the maintenance opening are preferably configured such that the siphon element is removable from the housing solely when the siphon element lies in its maintenance position. A removal of the siphon element is not possible when the siphon element is outside the maintenance position, thus in the usage position or between the usage position and the maintenance position.

Preferably, the drainage branch of the washstand and the connecting branch of the connection unit project from the rear wall of the washstand away to the rear and are in particular arranged such that the drainage branch, and optionally also the connecting branch, does not fall below or intersect a reference plane extending at right angles to the rear wall and extending through the bottommost edge of the rear wall.

Further embodiments are defined in the dependent claims.

BRIEF DESCRIPTION OF THE DRAWINGS

Preferred embodiments of the invention are described below with reference to the drawings, which serve merely for illustrative purposes and should not be interpreted restrictively. In the drawings.

DESCRIPTION OF PREFERRED EMBODIMENTS

In the figures, a drain arrangement 1 with a washstand 2 is shown. The drain arrangement 1 serves to carry away water out of the washstand 2.

Figure 1:
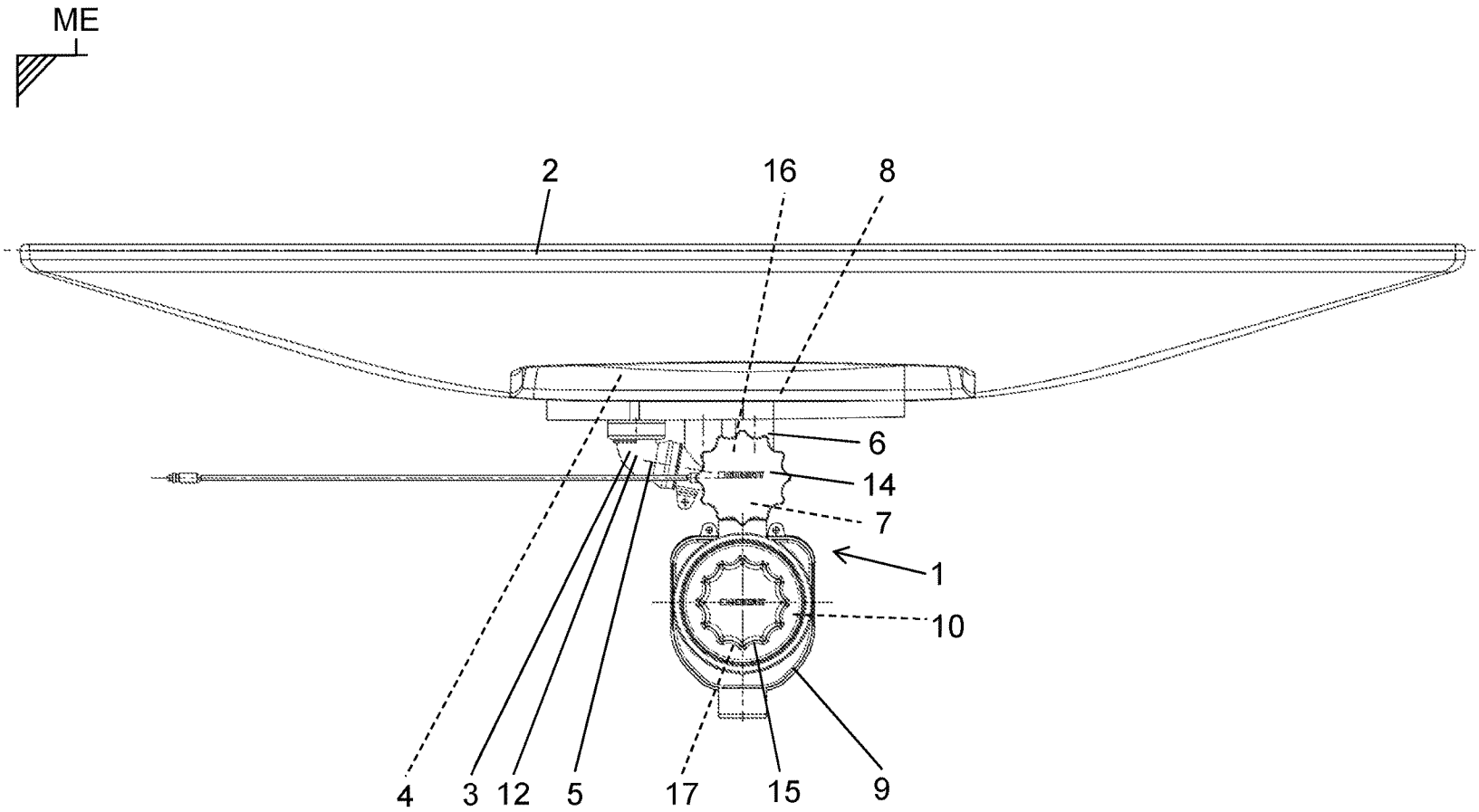
FIG. 1 shows a front view of a washstand having a drain arrangement according to one embodiment of the present invention.
Figure 2:
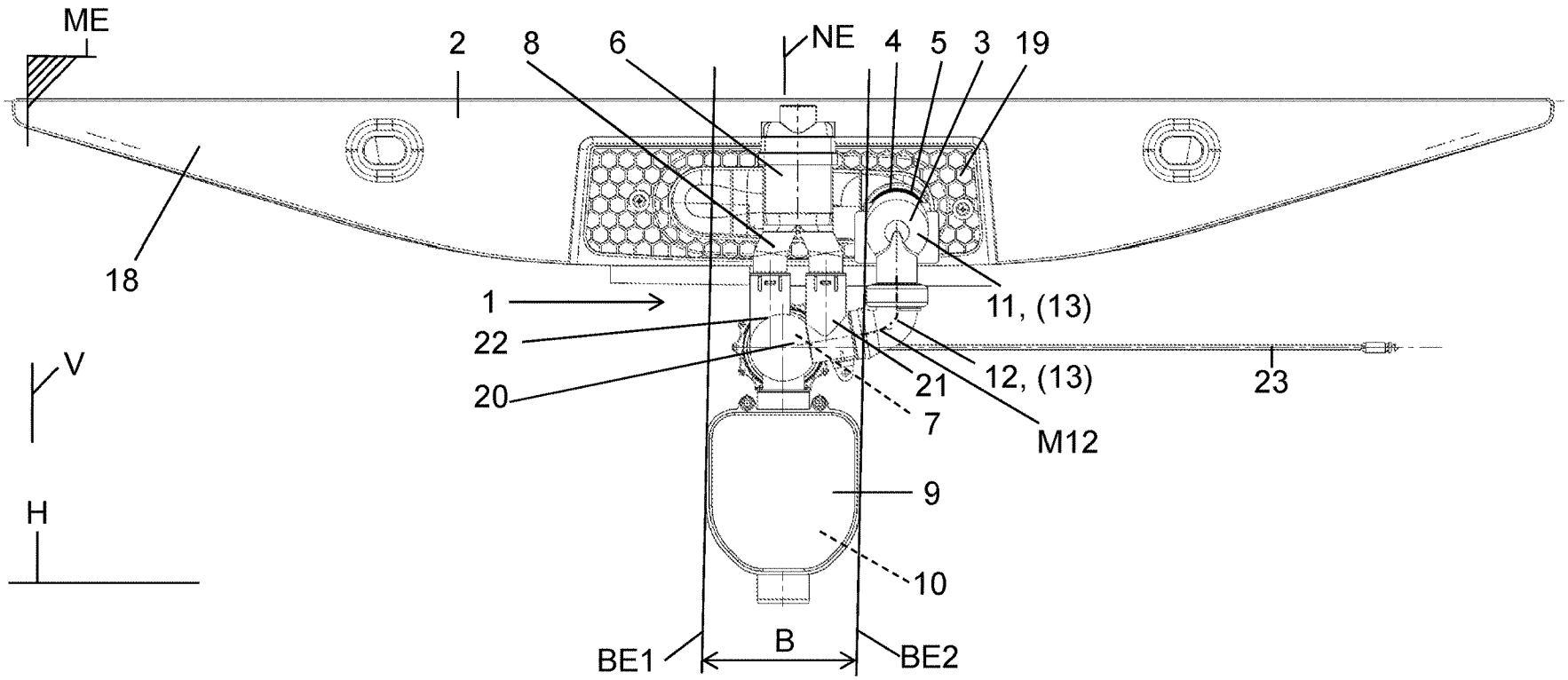
FIG. 2 shows a rear view of FIG. 1.

FIG. 1 shows a front view of the washstand 2 and of the drain arrangement 1. FIG. 2 shows a corresponding rear view.

The drain arrangement 1 for the washstand 2 comprises a connection unit 3, an overflow unit 6 and a siphon unit 9. The connection unit 3 is connected to the washstand 2 with a connecting branch 4. The connecting branch 4 serves for the connection to a drainage branch 5 of the washstand 2. Water is fed from a discharge opening 24 out of the washstand 2 to the drainage branch.

Adjoining the connection unit 3 is the overflow unit 6. The overflow unit 6 comprises a valve 7 and an overflow pipe 8 which bridges the valve 7 accordingly. The valve 7 can assume two positions, namely an open position, in which the water can flow through the valve 7, and a closed position, in which the water, when viewed in the direction of flow from the washstand 2, is retained, so that a user can fill the washstand 2 with water. The overflow pipe 8 is arranged such that the valve 7 is appropriately bridged. Hence, when the valve is closed, an emergency drainage can be provided in case the water should rise above the height of the overflow pipe 8. In the shown embodiment, the overflow pipe 8 is of U-shaped configuration. The overflow pipe 8 projects away from a pipe section 20 in which the valve 7 is arranged. The pipe section 20 comprises a first branch-off point 21 and a second branch-off point 22, both of which branch-off points 21, 22 open out into the overflow pipe 8. Between the two branch-off points 21, 22 is arranged the valve 7. The valve 7 is actuated via a drive element 23.

The overflow unit 8 is adjoined, as mentioned, by the siphon unit 9. The siphon unit 9 comprises a siphon element 10.

The water which is fed through the drainage branch 5 of the washstand 2 to the drain arrangement 1 flows firstly through the connection unit 3 and then flows into the overflow unit 6, from which it is ultimately fed to the siphon unit 9.

The rear view of FIG. 2 shows that the overflow unit 6 lies laterally offset from the connecting branch 4, to be precise such that the overflow pipe 8 extends upward alongside the connecting branch 4. That is to say that the overflow pipe 8 extends upward next to the connecting branch 4, counter to the plumb line direction. The space or the spatial conditions, respectively, can hence be utilized in a neat and optimized manner. The siphon unit 9 likewise lies laterally offset from the connecting branch 4 and beneath the overflow unit 6.

Figure 3:
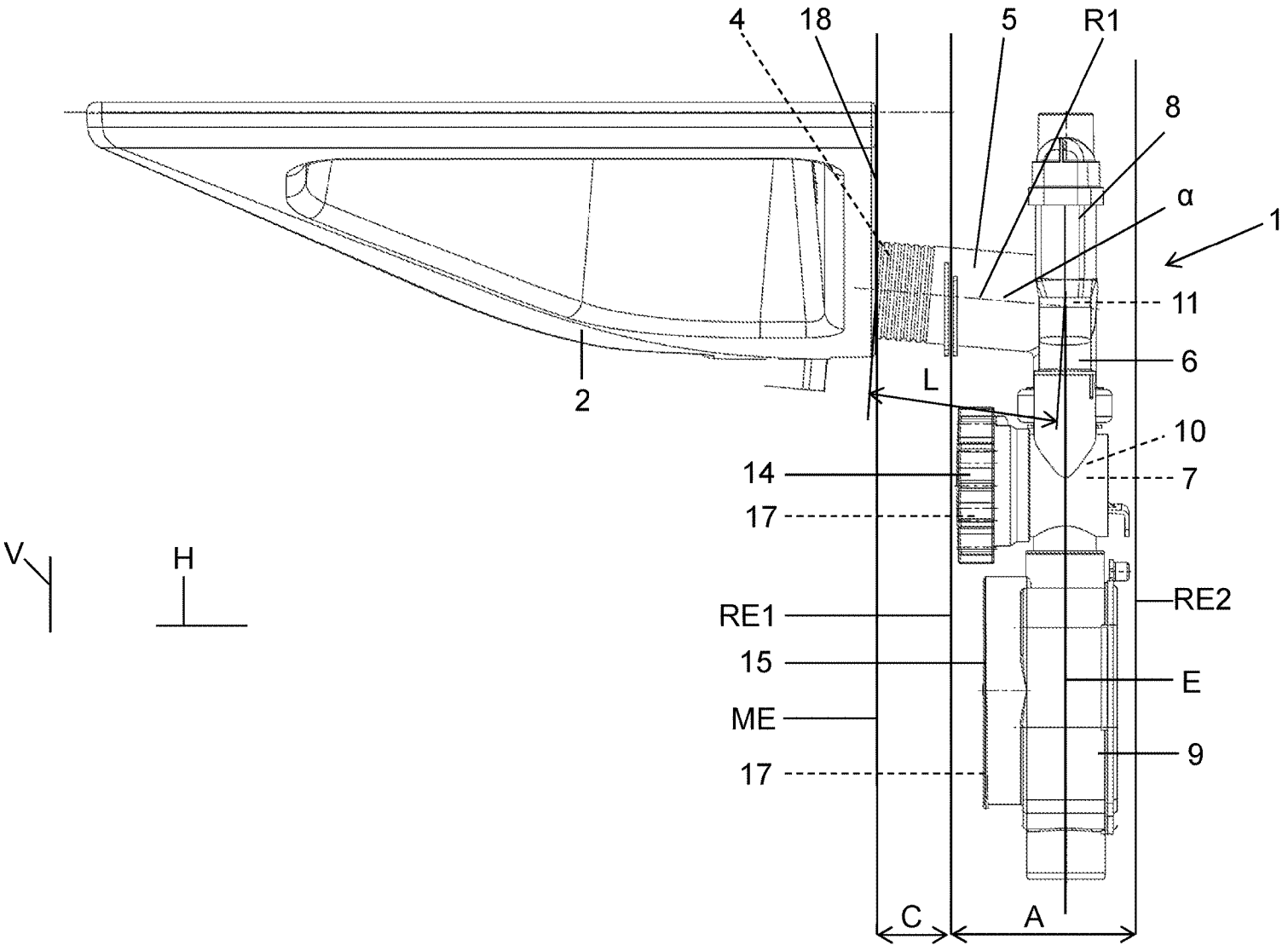
FIG. 3 shows a side view of FIG. 1.

FIG. 3 shows a side view of the drain arrangement 1 with the washstand 2. When viewed in the installation position, the connecting branch 4 extends in a first direction R1. The first direction R1 stands at an angle $\alpha$ of less than 30° degrees to an assembly plane ME lying in the vertical V. The assembly plane ME is defined by the rear wall 18 of the washstand or by the connecting structure to which the washstand is to be fitted. The connecting structure is, for instance, a wall. The inclination of the angle $\alpha$ is here such that it is downward with respect to the horizontal H.

The overflow unit 6 and the siphon unit 9 are arranged in such a way relative to one another that they lie between two reference planes RE1 and RE2 lying parallel to the assembly plane ME. In FIG. 3, the reference planes RE1, RE2 are marked accordingly. The reference planes RE1, RE2 extend in the vertical V and lie at a distance A inbetween each other. The overflow unit 6 and the siphon unit 9 here lie between the two reference planes RE1, RE2 such that the reference planes RE1, RE2 are not penetrated by the corresponding units 6, 9. The reference planes RE1, RE2 thus form boundary planes. The distance A between the two reference planes RE1, RE2 corresponds to maximally three times the length L of the connecting branch 4 and/or lies within a range from 7 to 15 cm.

The reference plane RE1, which lies closer to the assembly plane ME here, likewise lies at a distance from the assembly plane ME. The distance bears the reference numeral C. As a result of this distance, space is created for the feed-through of further elements, such as, for instance, a freshwater conduit (not shown) which is to be fitted to the washstand, or else appropriate corresponding tiled wall or another wall structure. The wall and the wall structure preferably comprise an access opening (not represented), through which the overflow unit 6 and the siphon unit 9 are accessible for maintenance works. The distance C between the first reference plane RE1 and the assembly plane ME is smaller than the distance A between the two reference planes RE1 and RE2. Preferably, the distance C lies between 10 and 60 millimeters.

When viewed from the washstand 2, the connecting branch 4 penetrates the first reference plane RE1 and then, in the region between the first reference plane RE1 and the second reference plane RE2, opens out into the overflow unit 6.

When viewed in the installation position, the overflow pipe 8 extends upward above the height of the connecting branch 4. That is to say that the connecting branch 4 lies beneath the upper end of the overflow pipe 8.

Equally, in the installation position, the valve 7 and the siphon unit 9 lie beneath the connecting branch 4 and the drainage branch 5.

Figure 4:
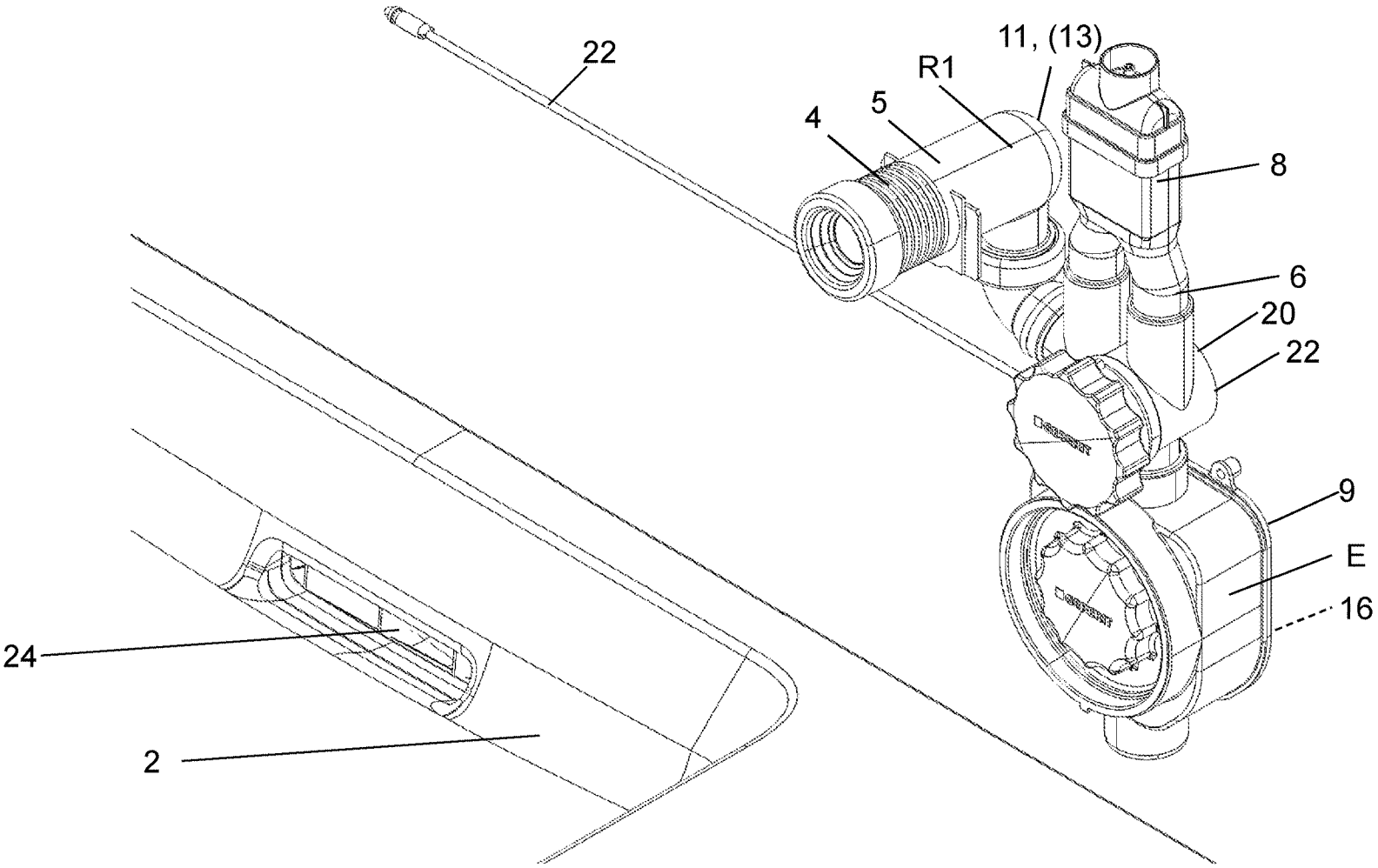
FIG. 4 shows a perspective view of FIG. 1 from the front, wherein the drain arrangement is represented separate from the washstand.
Figure 5:
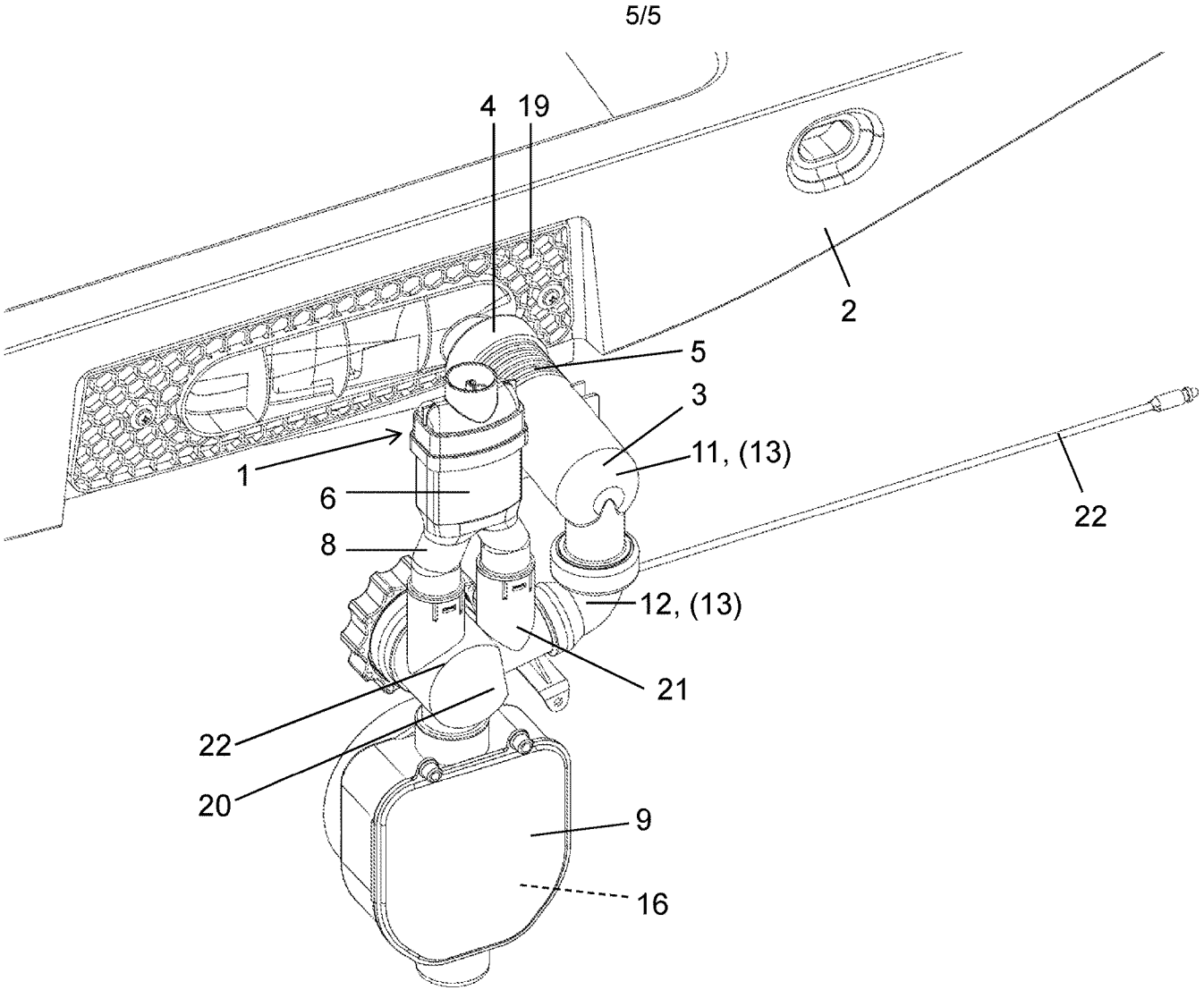
FIG. 5 shows a perspective view of FIG. 1 from the rear.

In FIGS. 4 and 5, perspective views of the drain arrangement 1 with the washstand 2 are shown. The connecting branch 4 runs along the first direction R1 through to a first diversion section 11. At the first diversion section 11, the direction of flow F is diverted from the first direction R1 downward into the vertical V. The connecting branch 4 further comprises a second diversion section 12, which, when viewed in the direction of flow F, is arranged downstream of the first diversion section 11. With the second diversion section 10, the direction of flow F is diverted again. The second diversion section 11 is then adjoined by the overflow unit 6. The orientation of the center axis M12 of the second diversion section 12, after diversion has taken place, is parallel to and at a distance from the assembly plane ME and slightly angularly inclined downward with respect to the horizontal H. This type of diversion has the advantage that the water can be optimally diverted to the height of the valve 7. In addition, the second diversion section 12 has the advantage that the connecting branch 4, in the region of the first direction R1 and through to the end of the second diversion section 12, is arranged alongside the overflow pipe 8, so that the overflow pipe 8 can extend next to and past the connecting branch 4.

The connecting branch 4 comprises at least one flexible section 13. Particularly preferably, at least one of the diversion sections 11, 12 is of flexible configuration. As a result of this flexible section 13, assembly tolerances are able to be compensated.

From all figures it becomes apparent that the center axes of the water-carrying regions in the overflow unit 6 and the siphon unit 9 lie substantially in a common plane E. The plane E lies between the two reference planes RE1, RE2 here, and extends substantially parallel to the assembly plane ME or to the reference planes RE1, RE2, respectively. As a result, the compactness with respect to the extent transversely to the assembly plane ME, thus between the distance A between the two reference planes RE1, RE2, is optimized accordingly. In addition, no complex diversion of the water in the direction of the vertical is realized.

Both the overflow unit 6 and the siphon unit 9 each have a maintenance opening 16, 17, which is closed off with a cap 14, 15. The maintenance opening 16 in the overflow unit 6 is arranged here such that the valve 7 becomes appropriately accessible when the cap 14 is removed. Therein, the maintenance opening 17 of the siphon unit 9 is configured such that the siphon element 10 can be removed from the siphon unit 9 upon removal of the cap 15. As a result, the seal 7 and a siphon element 10 are able to be maintained accordingly. Both the valve 7 and the siphon element 10 are not marked in the figures and are merely represented symbolically with dashed lines.

The two maintenance openings 16, 17 are accessible from the same access direction Z. The access direction Z runs substantially at right angles to the assembly plane ME and is marked accordingly in FIG. 3. Preferably, the two maintenance openings 16, 17 lie substantially one above the other in the vertical V. Furthermore, from FIG. 1 it can be seen that the two maintenance openings 16, 17 closed off with the cap 14, 15 lie, in the installation position, beneath the washstand. That is to say that the two caps 14, 15 and the corresponding maintenance openings 16, 17 are comparatively easily accessible.

The maximal lateral extent of the drain arrangement 1 is now explained in greater detail with reference to FIG. 2. The maximal lateral extent of the siphon unit 9 in the horizontal H and in a projection onto the assembly plane ME is shown in FIG. 2. The assembly plane ME runs in the direction of the page here. Through the maximal lateral extent runs one reference plane BE1, BE2 each. The two reference planes BE1, BE2 stand at a distance B from each other, which is defined by the corresponding extent of the siphon unit 9. Here, the two reference planes BE1, BE2 run at right angles to the assembly plane ME in the vertical V. The siphon unit 9 and the overflow unit 6 are arranged here in the region between the two reference planes BE. The reference plane BE2 is correspondingly penetrated by the connecting branch 4, so that this, in the region of the penetration point, then opens out into the overflow unit 6.

From FIG. 5, it is further apparent that the washstand 2, in the region of its rear wall, comprises a water tank element 19, from which the drainage branch 5 protrudes. The drainage branch 5 runs angularly inclined to the rear wall 18 such that it runs substantially collinearly to said connecting branch 4 of the drainage unit. In addition, the drainage branch 5 protrudes from said rear wall 18. The connecting branch 4 stands in close connection to the drainage branch 5. The water tank element 19 is configured separate from the washstand 2 and can be appropriately connected thereto.

Viewed in the installation position, the drainage branch 5 is arranged laterally offset from the washstand. That is to say that in the installation position, when viewed from the front, the drainage branch 5, with respect to a center plane NE which extends centrally in the vertical V through the washstand 2 and which runs at right angles to the assembly plane ME, is arranged laterally offset. The center plane NE is marked accordingly in FIG. 2. It can be clearly seen here that the drainage branch 5 lies distanced from this center plane NE. This distanced arrangement has the advantage that the residual elements of the drainage unit 1 can be arranged substantially in the middle of the washstand 2.

REFERENCE SYMBOL LIST

| | |
|---|---|
| 1 | drain arrangement |
| 2 | washstand |
| 3 | connection unit |
| 4 | connecting branch |
| 5 | drainage branch |
| 6 | overflow unit |
| 7 | valve |
| 8 | overflow pipe |
| 9 | siphon unit |
| 10 | siphon element |
| 11 | first diversion section |
| 12 | second diversion section |
| 13 | flexible section |
| 14 | cap |
| 15 | cap |

-continued

| | |
|---|---|
| 16 | maintenance opening |
| 17 | maintenance opening |
| 18 | rear wall |
| 19 | water tank element |
| 20 | pipe section |
| 21 | branch-off point |
| 22 | branch-off point |
| 23 | drive element |
| 24 | discharge opening |
| BE1 | first reference plane |
| BE2 | second reference plane |
| A | distance |
| B | distance |
| C | distance |
| R1 | first direction |
| E | plane |
| RE1 | first reference plane |
| RE2 | second reference plane |
| V | vertical |
| H | horizontal |
| ME | assembly plane |
| NE | center plane |
| L | length |
| α | angle |
| M12 | center axis |
| Z | access direction |

The invention claimed is:

1. An arrangement comprising a drain arrangement and a washstand, wherein said drain arrangement comprises:

a connection unit comprising a connecting branch for connection to a drainage branch of a washstand;

an overflow unit adjoining the connection unit and comprising a valve and an overflow pipe that bridges the valve; and a siphon unit adjoining the overflow unit and comprising a siphon element, wherein the connecting branch, when viewed in the installation position, runs in a first direction that is oriented angularly inclined, at an angle, downward toward an assembly plane of the washstand, the assembly plane runs in a vertical direction, wherein the overflow unit lies laterally offset from the connecting branch such that the overflow pipe extends upward alongside the connecting branch, wherein the siphon unit lies beneath the overflow unit, wherein the washstand has a rear wall, such that the washstand is fittable to a connecting structure defining the assembly plane, wherein in a region adjoining a top side of the washstand said rear wall extends over the entire width of the washstand, and wherein the washstand has a drainage branch that protrudes from said rear wall and that runs collinearly to said connecting branch, wherein, in the installation position, the connecting branch penetrates the assembly plane, and wherein the overflow unit and the siphon unit are arranged, with respect to the assembly plane, opposite the washstand.

2. The arrangement as claimed in claim 1, wherein, in the installation position, the connecting branch penetrates the assembly plane, wherein the overflow unit and the siphon unit lie behind the assembly plane, and wherein the washstand lies in front of the assembly plane.

3. The arrangement as claimed in claim 1, wherein the arrangement further has a wall structure that with a front side, defines the assembly plane, wherein the washstand is arranged in front of the wall structure, wherein the connecting branch penetrates the wall structure, and wherein the overflow unit and the siphon unit lie behind the wall structure.

4. The arrangement as claimed in claim 1, wherein the drainage branch, with respect to a center plane that in the installation position, when viewed from the front, extends centrally in the vertical through the washstand and that runs at right angles to the assembly plane, is arranged laterally offset from the center plane.

5. The arrangement as claimed in claim 1, wherein in the installation position and when viewed from the side, the overflow unit and the siphon unit are arranged such that these lie between two reference planes lying parallel to the assembly plane, wherein the reference planes have a distance between each other that corresponds to maximally three times the length of the connecting branch; and/or wherein the reference planes have a distance between each other that lies between 7 and 15 centimeters.

6. The arrangement as claimed in claim 5, wherein the reference planes lie at a distance from the assembly plane, and wherein the distance between the assembly plane and the first reference plane lying closer to the assembly plane is smaller than the distance between the two reference planes.

7. The arrangement as claimed in claim 5, wherein the connecting branch, when viewed from the washstand, penetrates the first reference plane and, between the first reference plane and the second reference plane, opens out into the overflow unit.

8. The arrangement as claimed in claim 5, wherein the reference planes lie at a distance from the assembly plane, wherein the distance between the assembly plane and the first reference plane lying closer to the assembly plane is smaller than the distance between the two reference planes, and wherein the connecting branch, when viewed from the washstand, penetrates the first reference plane and, between the first reference plane and the second reference plane, opens out into the overflow unit.

9. The arrangement as claimed in claim 1, wherein, in the installation position, the overflow pipe extends upward over the height of the connecting branch.

10. The arrangement as claimed in claim 1, wherein, in the installation position, the valve and the siphon unit lie beneath the connecting branch or the drainage branch, respectively.

11. The arrangement as claimed in claim 1, wherein the connecting branch comprises a first diversion section that diverts the direction of flow from the first direction downward into the vertical, wherein the connecting branch comprises a second diversion section that is arranged following the first diversion section and that diverts the direction of flow again, and wherein the orientation of the center axis of the second diversion section, after diversion has taken place, is parallel to and at a distance from the assembly plane and angularly inclined downward with respect to the horizontal.

12. The arrangement as claimed in claim 11, wherein the second diversion section is adjoined by the overflow unit.

13. The arrangement as claimed in claim 1, wherein the connecting branch has at least one flexible section.

14. The arrangement as claimed in claim 13, wherein the center axes of water-carrying regions in the overflow unit and the siphon unit lie in a common plane that runs parallel to the assembly plane.

15. The arrangement as claimed in claim 1, wherein the overflow unit and the siphon unit each have a maintenance opening closed off with a cap, and wherein the two maintenance openings are accessible from the same access direction.

16. The arrangement as claimed in claim 15, wherein said access direction runs at right angles to the assembly plane; and/or wherein the two maintenance openings, when viewed in the vertical, lie one above the other, and/or wherein the maintenance openings closed off with the cap lie, in the installation position, beneath the washstand.

17. The arrangement as claimed in claim 1, wherein, through a maximal lateral extent of the siphon unit in the horizontal direction, in a projection onto the assembly plane, there runs a reference plane on each of two sides of the siphon unit, these reference planes run at right angles to the assembly plane in the vertical, and wherein the siphon unit and the overflow unit are arranged in the region between the two reference planes.

18. The arrangement as claimed in claim 13, wherein at least one of the diversion sections is of flexible configuration.

19. The arrangement as claimed in claim 1, wherein the washstand, in the region of its rear wall, comprises a water tank element that the drainage branch protrudes from.

20. The arrangement as claimed in claim 19, wherein said water tank element is arranged in a cavity that extends from said rear wall into the washstand, wherein the cavity interrupts said rear wall.

21. The arrangement as claimed in claim 20, wherein the water tank element is configured separate from the washstand and can be appropriately connected thereto.

22. The arrangement as claimed in claim 19, wherein the water tank element is configured separate from the washstand and can be appropriately connected thereto.

* * * * *